US005093652A

United States Patent [19]

Bull et al.

[11] Patent Number: 5,093,652

[45] Date of Patent: Mar. 3, 1992

[54] DISPLAY DEVICE

[75] Inventors: Stephen D. Bull, Ripley; Christopher J. Morris, Feltham, both of England

[73] Assignee: Thorn EMI plc, London, England

[21] Appl. No.: 660,265

[22] Filed: Feb. 26, 1991

Related U.S. Application Data

[63] Continuation of Ser. No. 278,510, Dec. 1, 1988, abandoned.

[30] Foreign Application Priority Data

Dec. 4, 1987 [GB] United Kingdom ..... 8728433

[51] Int. Cl.[5] ..... G09G 3/20

[52] U.S. Cl. ..... 340/701; 340/784

[58] Field of Search ..... 340/701, 702, 703, 765, 340/784, 793; 350/339 F, 350 S

[56] References Cited

U.S. PATENT DOCUMENTS

| | | | |
|---|---|---|---|
| 4,559,535 | 12/1985 | Watkins et al. | 340/793 |
| 4,610,509 | 9/1986 | Sorimachi et al. | 340/702 |
| 4,638,310 | 1/1987 | Ayliffe | 340/784 |
| 4,655,561 | 4/1987 | Kanbe et al. | 350/350 |
| 4,709,995 | 12/1987 | Kuribayashi et al. | 340/793 |
| 4,769,713 | 9/1988 | Yasui | 340/793 |

FOREIGN PATENT DOCUMENTS 0261901 3/1988 United Kingdom .

*Primary Examiner*—Jeffery A. Brier

*Attorney, Agent, or Firm*—Fleit, Jacobson, Cohn, Price, Holman & Stern

[57] ABSTRACT

A display device has a lattice of pixel elements each selectably settable. A method of operating the display device comprises the steps of receiving a signal representing a picture for display during a display period and illuminating the lattice to produce, during a first interval within the display period, a first light output from the lattice having a first predetermined color characteristic and to produce at least one additional light output from the lattice. Each said additional light output has a different predetermined color characteristic and a respective interval within the display period separate from the first interval. The method further comprises the step of time-multiplex addressing blocks of pixel elements a plurality of address times during each interval. The addressing step includes setting a group of blocks, the group consisting of a plurality of blocks spaced apart in the addressing sequence such that the blocks in the group form a series with adjacent blocks having a temporal separation in the addressing sequence exhibiting a geometric progression with a common ratio N being an integer equal to 2 or more. In this way, addressing of the lattice occurs simultaneously with its illumination by the appropriate color, allowing a greater proportion of the frame time for the addressing operation so that additional addressing information can be utilized.

9 Claims, 4 Drawing Sheets

COLOUR SEQUENTIAL BACKLIGHTING
R
G
B
8
SERIAL DATA TO DISPLAY DRIVERS
OUTPUT CONTROL CIRCUITS
LAMP FLASH CONTROLLER
14
DATA BUS 8 BITS
DATA BUS 8 BITS
DATA BUS 8 BITS
6
6
6
RAM (MSB)
RAM (BIT2)
RAM (LSB)
RAM ADDRESS BUS
MSB
BIT2
LSB
ADDRESS GENERATION ROM.
12
PICTURE STORE.
4R
4G
4B
RED DATA
GREEN DATA
BLUE DATA
4
11
TIMER
10
VIDEO SOURCE
2
CLOCK IN

| | $t_1$ | $t_4$ | $t_1$ | $t_2$ | $t_3$ | $t_4$ | $t_5$ | $t_6$ |
|---|---|---|---|---|---|---|---|---|
| 1 | 1 | 1 | 1 | | | | | 1 |
| 2 | 0 | 1 | | | | 1 | | |
| 3 | 1 | 0 | | 1 | | | | |
| 4 | 0 | 1 | | | | | 1 | |
| 5 | 0 | 0 | | | | | | |
| 6 | 0 | 0 | | | | | | |
| 7 | 1 | 0 | | | 1 | | | |

DISPLAY DEVICE

This application is a continuation of application Ser. No. 07/278,510, filed Dec. 1, 1988 now abandoned.

The present invention relates to a display device, and particularly to a liquid crystal display device.

In a conventional colour sequential display using a matrix of liquid crystal cells, the matrix is set and then illuminated three times each frame period, one setting and illumination operation being associated with each of the red, green and blue components of the image for display. The duration of illumination of each colour is proportional to the significance of the bit written to the display. However, this system is limited in that each pixel's brightness is represented by three binary numbers, one assigned to each colour. Moreover, much of the frame time is taken up in the setting operations of the display, during which there can be no illumination.

An object of the present invention is to provide a colour liquid crystal display device and a method of operating such a device which at least alleviates the above-described disadvantages.

According to a first aspect of the present invention there is provided a method of operating a display device having a lattice of pixel elements, each selectably settable, the method comprising:

receiving a signal representing a picture for display during a display period;

illuminating the lattice to produce, during a first interval within the display period, a first light output from the lattice having a first predetermined colour characteristic and to produce at least one additional light output from the lattice, each said additional light output having a different predetermined colour characteristic and having a respective interval within the display period of one picture and separate from the first interval;

and time-multiplex addressing blocks of pixel elements a plurality of address times each interval;

the addressing step including setting a group of the blocks, said group consisting of a plurality of blocks spaced apart in the addressing sequence such that the blocks in said group form a series with adjacent blocks having a temporal separation in the addressing sequence exhibiting a geometric progression with a common ratio N being an integer equal to 2 or more.

In this way, addressing of the lattice occurs simultaneously with its illumination by the appropriate colour, allowing a greater proportion of the frame time for the addressing operation so that additional addressing information can be utilised. Thus in one advantageous embodiment, in each of three address operations (one for each primary colour) in a frame, for two-state pixels eight possible grey levels for a pixel are provided.

Preferably said step of illuminating the lattice includes a first step of illuminating the lattice during said first interval with a light source of said first predetermined colour characteristic and a second step of illuminating the lattice during said a respective interval with a light source of said a different predetermined characteristic.

The present invention embodies a technique forming an inventive combination of two matrix-addressing schemes which, as they stand, are mutually incompatible; these schemes are the conventional colour sequential addressing system described above which requires that the setting operation for the matrix be completed before it is illuminated with the appropriate colour light, and a group time-multiplex addressing system which requires that the matrix is illuminated while the data is being written.

Preferably the method further comprises the step of blanking the lattice prior to each interval. Advantageously, this step has a longer duration than a switching period between said first and second steps of illuminating the lattice.

The present invention provides a substantial advantage over the conventional colour displays, in which the matrix is not illuminated for a large part of the picture period (namely 3n field periods, where n is the number of binary bits per primary colour). In contrast, in the present invention the display is dark during only e.g. there short periods, once for each primary colour, per picture, each period being merely the time required to switch the lamps or other light sources, in the illumination means, on and off as appropriate.

According to a second aspect of, the present invention there is provided a display device comprising:

a lattice of pixel elements each selectably settable in dependence on a respective part of a received signal representing a picture for display in a display period;

means for illuminating the lattice to produce, during a first interval within the display period, a first light output from the lattice having a first predetermined colour characteristic and to produce at least one additional light output from the lattice, each said additional light output having a different predetermined colour characteristic and having a respective interval within the display period and separate from the first interval;

and means for time-multiplex addressing blocks of pixel elements a plurality of address times for each interval of the illumination means;

the addressing means including means for setting a group of blocks, said group consisting of a plurality of blocks spaced apart in the addressing sequence such that the blocks in said group form a series with adjacent blocks having a temporal separation in the addressing sequence exhibiting a geometric progression with a common ratio N being an integer equal to 2 or more.

Another aspect of the present invention provides equipment suited and/or designed for the generation of signals of a format for a display device embodying the present invention, for example of a format as described and shown herein. Further aspects of the present invention provide equipment suited and/or designed for the transmission of such signals, equipment suited and/or designed for the reception of such signals, and equipment for the processing of such signals. Thus, for example, the present invention embodies a driver integrated circuit which is suited and/or designed for the addressing of a display device in the manner herein described.

In order that the invention may more readily be understood, a description is now given, by way of example only, reference being made to the accompanying Figures of which:

For a display with pixels each having N brightness or selectively settable states the number of perceived brightness states or grey levels is increased by using time dither, that is to say that the pixels can be moved from one state to another in a pattern such that intermediate brightness levels are perceived. A convenient way of doing this is by using a set of M time periods whose lengths differ by a factor of N. The pixel can then be set at a different brightness level during each time period giving $N^M$ available brightness or grey levels. Thus, the technique operates in a number base which is set by the number of states that a given pixel on the display can be in. Matrix addressed displays are written line by line and this has to be taken account of when allocating the weighted time periods.

In a non-sequential group time-multiplex addressing scheme, e.g. as disclosed in our copending European Patent Application No. 261901A or copending U.S. patent application Ser. No. 07/175,405, the weighted time periods are achieved as a logical consequence of the order in which the rows of pixel elements are to be scanned. For a scheme with M time periods whose lengths differ by a factor N, the minimum number of rows in the lattice of pixels is $$\frac{(N^M - 1)}{(N - 1)}$$

Accordingly, a lattice of pixels operated by such a scheme preferably has a number of rows equal to a multiplex x of $$\frac{(N^M - 1)}{(N - 1)}.$$

Where x is greater than one, the lattice of pixels can be divided into blocks of rows, preferably with the number of rows in a block equal to x. (In the case where x=1, the block comprises one row).

Figure 1:
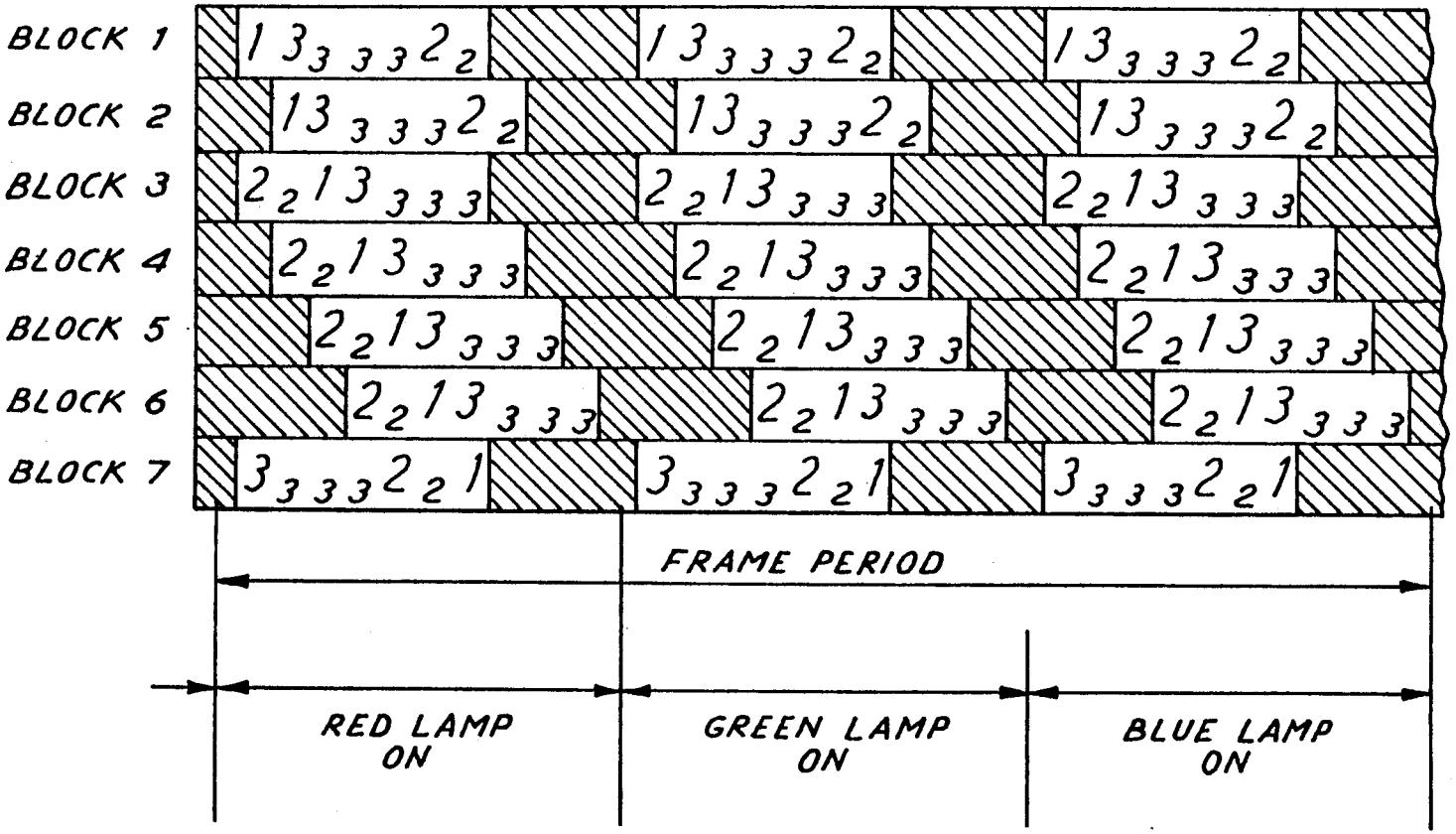
FIG. 1 shows schematically an addressing scheme provided in accordance with the present invention.

In such a scheme, a signal representing a picture for display in a display period comprises a plurality of portions each representing the data for setting a pixel element in the lattice, each such portion being constituded by a plurality of sections or bits, a section representing the addressing data for the pixel element in respect of one address in that picture. Thus, for a scheme as shown in FIG. 1, in which N=2 and M=3, allowing eight grey levels, the number of times for which any pixel element is addressed for one picture is 3 and hence, the number of sections in the portion of the signal representing that pixel element is 3. In FIG. 1, the large-format numbers represent a block written with that significant bit while small-format numbers represent data still displayed due to bistability of the liquid crystal cells.

After being addressed, the pixel elements remain, or are maintained, set until the next addressing occurs. Thus the time duration of a pixel being set depends on the temporal separation in the addressing sequence between the block of that pixel and the following block, this separation having a geometric progression relationship in a group as hereinbefore indicated. Thus the addressing means operates to set a block for a first predetermined time interval in one address for a given picture, and then to set the block for a second predetermined time interval in another address for that picture, thereby providing differing setting times for different addresses of a block for a given picture.

In a general N, M non-sequential group addressing scheme, the required brightness at each pixel for each colour on the display is first converted to base N. During the first group address interval the first group of blocks of lines is written to. Row block numbers $$\frac{(N^k - 1)}{(N - 1)}$$

are members of this group for $k \epsilon (1 \ldots M)$.

Each pixel in each of these blocks of rows has the kth digit of the base N representation of its brightness written on it. Thus pixels in the first block of rows have their least significant digits written to them and pixels in row block N+1 have their next most significant digit written to them, and so on. In the following group address intervals successive groups are written to in a similar fashion. Successive groups are obtained by adding 1 module j+1 to the collection number of each member of the previous group, where j is the total number of blocks of rows.

The order in which the row blocks within a group are written is chosen to minimise the errors introduced by the finite switching speed of the pixel elements. The total error decreases as N increases. The rows within each block of rows can be written to in any sequence so long as this sequence is maintained each time they are written to.

FIG. 1 shows one video frame with three colours and illustrates a technique for implementing greyscale in a display incorporating a matrix of ferroelectric liquid crystal display cells which realises colour using a colour sequential backlight system, whilst avoiding the limitation of having to send data to the display with the backlight off. The first coloured backlight, that relating to the red image, is switched on to illuminate the lattice while the display is in the dark (i.e. blanked) state. The display is then addressed in the group time-multiplex manner, with red information for each pixel in a block being addressed a number of times corresponding to the number of bits to be displayed for each colour.

In the first group-address period, the first block of rows has the least significant bit written to it; the third block of rows has the second significant bit written to it; the seventh block of rows has the most significant bit written to it. In the second group-address period, the addressed blocks have moved one block down the displays. Thus block 2 has its least significant bit written to it; block 4 has its second significant bit written to it and block 1 (which is the block after block 7) has its most significant bit written to it. As can be seen, the least significant bit was on display for one group address period only. Similarly, the second significant bit is on display for two group-address periods and the most significant bit is on display for four group address periods. This means that data written to blocks of rows is displayed for a period of time corresponding to the significance of the bit displayed. In this way, a light output having grey level information and a predetermined colour characteristic (red) is produced from the display.

After each block of rows has been through its full addressing routine for red, the pixels are set to their dark state as can be seen in FIG. 1. When all of the rows of the display have been turned dark (i.e. the whole lattice has been blanked), the next lamp is lit (the green) and the same form of addressing is repeated for this next colour. This is repeated for the final coloured lamp (the blue) and for consecutive frames. So if provision is made for 600 μs blanking period between each coloured field (i.e. interval for which a light source of each colour is 'on') to allow for the attack and decay times of the coloured lamps, there is a total of 12.7 ms available for each colour in one video frame period (i.e. display period) of 40 ms. Data sent to the screen in each lamp period is integrated by the eye to produce a full colour picture.

As an example, consider the case of a X row display with a row address time of 20 μs, each of the three colours displaying a 3-bit greyscale; then,

| | | |
|---|---|---|
| rows addressed per time period | = | $X * (2^{(N-1)} - 1)/(2^N - 1)$ |
| | = | $3 * X/7$ |
| total number of time periods | = | $2^{(N-1)} + 2^N - 2$ |
| | = | 10 |
| therefore time taken per colour | = | 20 μs * 30 * X/7 |
| (if number of rows 'X' = 150 then) | = | 12.9 ms |
| Frame time | = | 40.4 ms |
| Actual active time | = | 7/10 of total |
| Active time for conventional scheme (for 1 bit only) | = | 7.75/10 of total |

It can be seen that the technique of the present invention showing a 3-bit greyscale is approximately as efficient in light output as the conventional scheme with only one bit of greyscale per colour. Also, the present invention has sufficient capacity to cater for a number of bits per colour to account for the eye's sensitivity (i.e. more greylevels in green), so that still greater improvement over the conventional field sequential scheme can be achieved. As the response of liquid crystal materials become faster, each row can be addressed more frequently in each frame, so the number of bits of greyscale displayed for each colour by the present invention can be increased, thus increasing the efficiency of the new scheme still further over the conventional one, i.e. the active time becomes progressively greater than 7/10 of the frame time.

Clearly, this invention is applicable to group time-multiplex techniques having pixels with a greater number of states, and with N equal to three or more, particularly advantageous values being N equal to four, eight or sixteen. Preferably N is equal to the number of states of the pixel.

Figure 2:
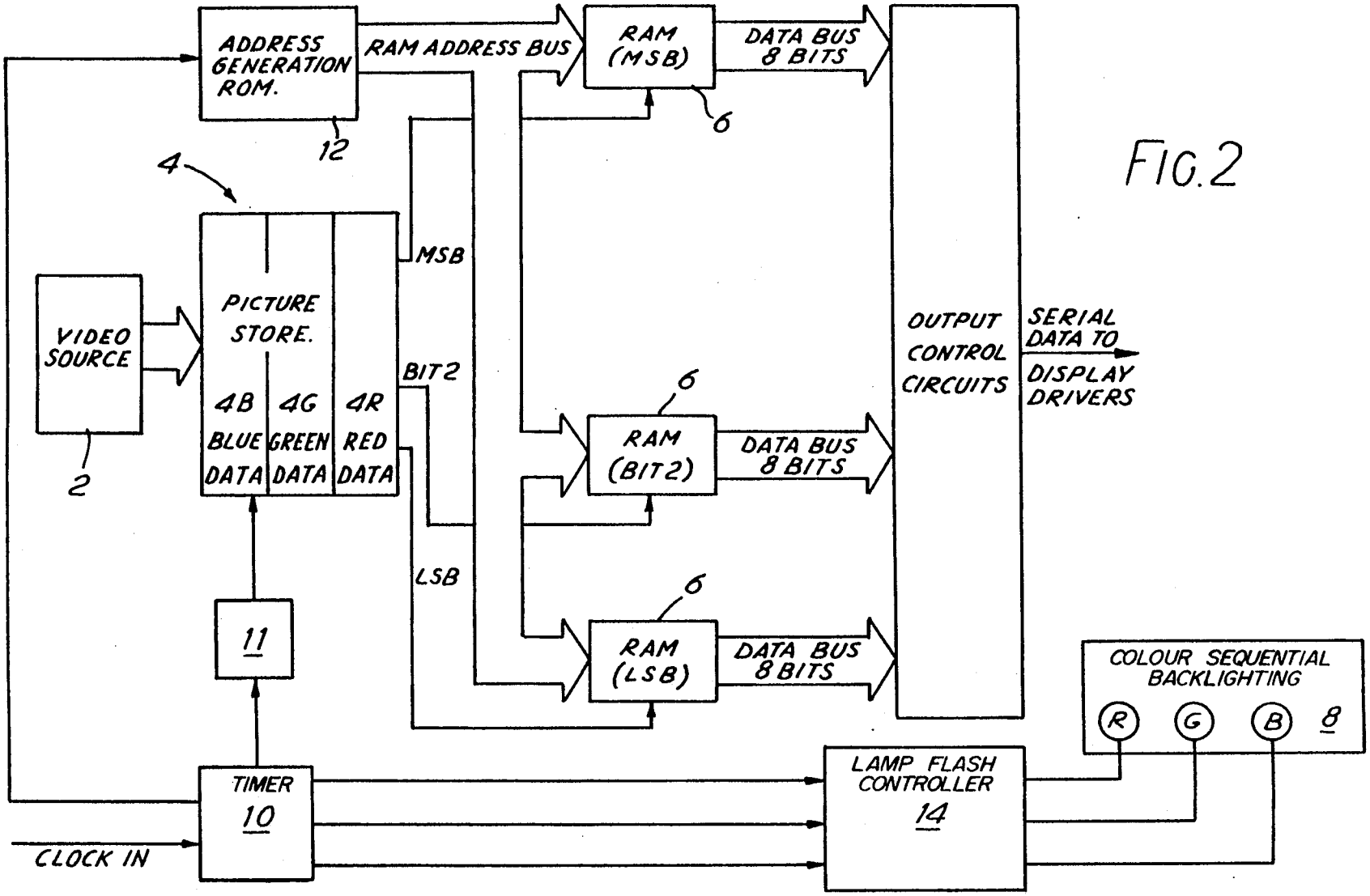
FIG. 2 shows a block diagram of a circuit for putting the invention into effect.

FIG. 2 is a block circuit diagram for a display device in which the blocks are addressed in blocks containing 8 bits. A signal is received from a video source 2 and stored in a picture store 4 with a capacity to hold a sufficient amount of the video signal to represent the display of a complete image, i.e. one picture of the video signal for display during a display period. The data is read into the picture store 4 so that the data for the three primary colours blue, green and red are stored separately in stores 4B, 4G, 4R respectively.

Data is accessed from the relevant part of the picture store 4, each bit then being stored in one of three RAMs 6 depending on its significance. Data is then retrieved from the RAMs 6 in a fashion suitable to write a bit of a particular significance to a block of rows of the display in one operation. The resultant signals are passed to control circuits and pixel drivers which operate on a lattice of pixels.

The addressing of the pixel elements and the flashing of colour sequential backlighting 8 are synchronised by timing signals from timing means 10. The timing signals are applied to the picture store 4 via an address ROM 11, to the address generation ROM 12 (which causes information to be retrieved from the RAMs 6) and to a lamp flash controller 14.

As outlined hereinbefore, a light source to produce a light output of a first predetermined colour characteristic (e.g. red) is switched on while the pixels are in a blanked state. During a first interval, the pixels in the lattice are addressed with information from the red store 4R to produce a red light output with 8 possible grey levels. When all the pixels have returned to the blanked state, a light source to produce a light output of a second predetermined colour characteristic (e.g. green) is switched on. During a following interval, the pixels in the lattice are addressed with information from the green store 4G. The process is repeated for the final colour blue.

Figure 3:
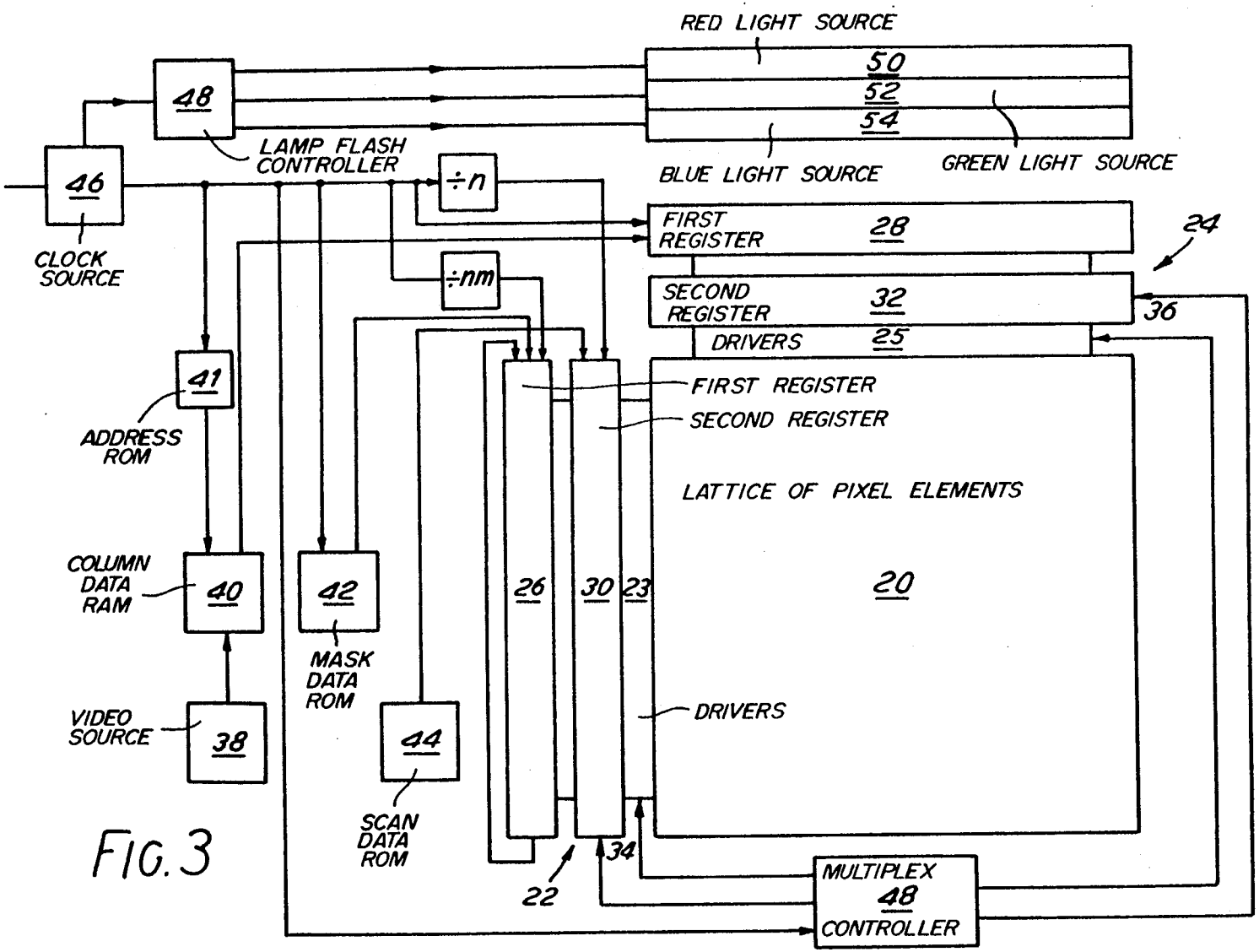
FIG. 3 shows a block circuit diagram of a display device provided in accordance with the present invention.

FIG. 3 shows a more detailed block circuit diagram of a display device for implementing the present invention with a lattice of pixel elements (indicated generally at 20) and a first versatile shift arrangement 22 for selecting the addressing of the rows via a plurality 23 of drivers and XOR gates and a second versatile shift arrangement 24 for selecting the addressing of the columns via a plurality 25 of drivers and XOR gates. Each versatile shift arrangement 22, 24 comprises first register means 26, 28 and second register means 30, 32. A control input 34 to the second register means 30 for addressing the rows is held high so that this register means 30 is in bypass mode. A control input 36 to the second register means 32 for addressing the columns is held low so that this register means 32 is effective as a set of transparent latches.

It the second register means 30 is in bypass mode, then information present in a stage of the first register means 26 determines whether or not the corresponding stage in the second register means 30 is bypassed or can be enabled.

A signal is received from a video source 38 corresponding to one picture in length and stored in a column data RAM 40 (shown in more detail in FIG. 2). The order in which the pixels are to be written for each colour characteristic is determined by an address ROM 41. A mask data ROM 42 determines the position of the members of a group to be addressed in the non-sequential group addressing scheme used. This information is loaded serially into the first shift register means 26 of the row versatile shift arrangement 22. A strobe bit from a scan data ROM 44 is loaded into the second shift register means, its position determining which of the rows or blocks of rows is to be strobed as outlined below with respect to FIG. 4.

Figures 4, 5:
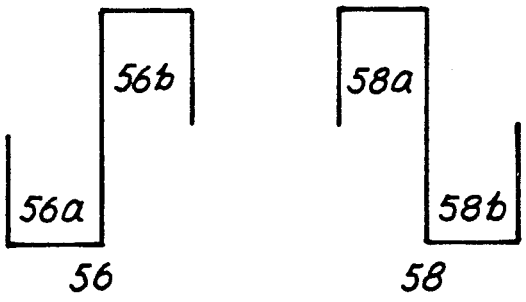
FIG. 4 illustrates the addressing of blocks of rows in the device of FIG. 3.
FIG. 5 shows typical column waveforms for a matrix-array type addressing method.

FIG. 4 shows how the blocks of rows are to strobed using the versatile shift arrangement 22 of FIG. 3. The first column indicates the position of blocks of pixel elements and the associated register stages of the first register means 26 and second register means 30. The second set of columns indicates the information present in the register stages of the first register means 26 at times $t_1$ and $t_4$. The third set of columns indicates the output of the corresponding stages of the second register means at times $t_1$ to $t_6$.

As M=3, the group of blocks to be addressed in any addressing step consists of three members. The position of each member of the group for time $t_1$ is loaded into the appropriate stages of the first register means as bits '1', the other stages in the first register means being loaded with bits '0'. The strobe select bit is clocked along the second register means. If the input to a stage of a second register means from the respective stage of the first register means is low, i.e. contains a bit '0', then that stage is bypassed. If the input to a stage of a second register means from the respective stage of the first register means is high, i.e. contains a bit '1', then that stage is enabled and the corresponding block of pixel elements is strobed. Thus, at time $t_1$, block 1 is strobed. At time $t_2$, the strobe bit would be clocked to strobe block 2 but this stage in the second register means has been bypassed as the respective stage in the first register means contains a '0'. Accordingly, the strobe bit is passed to the next stage in the second register means which has not been bypassed. This stage is 3 so block 3 is strobed at time $t_2$. Similarly at time $t_3$, block 7 is strobed. After time $t_3$, all the members of the group have been strobed and so a signal clock pulse to the first register means moves the positions of the whole group along by one position, and the addressing continues. Thus, the order in which the blocks is addressed is 1, 3, 7, 2, 4, 1 etc. The first register means is effective as a mask to specify which of the stages in the second register means should be bypassed.

When clock pulses of frequency f from a source 46 are applied to the column data RAM 40 via the address ROM 41, data for pixels of the next block to be strobed is loaded serially into the first shift register means 28 of the column versatile shift arrangement 24 and hence is present at the output of the register stages of the second shift register means 32. Accordingly if the number of pixels in a row is n, then a clock pulse of frequency f/n is applied to the second shift register means 30 of the row versatile shift arrangement 22 to clock the strobe bit and a clock pulse of frequency fm/nm is applied to the first shift register means 26 to move the positions of the members of the group along by one. (the value of m is determined by the particular non-sequential group addressing scheme used). A multiplex controller 48 controls the waveforms to be produced by the column drives and XOR gates 23, 25 in response to the data loaded into the versatile shift arrangements 22, 24.

The addressing of the pixel elements and the flashing of the colour sequential backlighting are synchronised by timing signals from the source 46 of clock pulses. The timing signals are applied to the column data RAM 40 (shown in more detail in FIG. 2) via the address ROM 41 and to a lamp flash controller 49 which controls the flashing of three light sources 50, 52, 54 of colours red, green and blue.

The outputs of the stages in the second register means are connected to the inputs of exclusive-or (XOR) gates, which is particularly advantageous for arrangements 24 used for addressing columns. The truth table for an XOR gate is shown below.

| Input 1 | Input 2 | Output |
|---|---|---|
| 0 | 0 | 0 |
| 0 | 1 | 1 |
| 1 | 0 | 1 |
| 1 | 1 | 0 |

In a matrix-array type addressing method in which blocks or rows of pixel elements are strobed, the waveform applied to a column determines whether or not the pixel at the intersection of the strobed block and that column is 'on' or 'off'. FIG. 5 shows an example of a column 'on' and a corresponding column 'off' waveform. As can be seen, each waveform 56, 58 can be divided into a subwaveforms 56*a*, 56*b*; 58*a*, 58*b* of the same shape but a different polarity. Thus, if a negative polarity subwaveform 56*a*, 58*b* is produced by a stage with a '0' output and a positive polarity subwaveform 56*b*, 58*a* is produced by a stage with a '1' output, it is possible to generate the required waveforms at the column drivers by loading in a '0' or a '1' at the appropriate register stage to generate the subwaveform of the correct polarity. The output of the register stage is connected to the input of an XOR gate follows the input. The other subwaveform can then simply be generated by changing the other input of the XOR gate to '1'.

Modification to the embodiments described and within the scope of the present invention will be apparent to those skilled in the art.

We claim:

1. A method of operating a display device having a lattice of pixel elements such selectably settable, the method comprising:

receiving data representing a picture for display during a display period, which data comprises data-bits weighted in accordance with their significance;

illuminating the lattice to produce, during a first interval within the display period, a first light output from the lattice having a first predetermined colour characteristic and to produce at least one additional light output from the lattice, each said additional light output having a different predetermined colour characteristic and having a respective interval within the display period separate from the first interval; and time-multiplex addressing, with the data, blocks of pixel elements a plurality of address times during each interval;

the blocks of pixel elements for time-multiplex addressing being selected such that they are spatially separated in accordance with a binary sequence, and selected blocks are selectively set for display in accordance with the significance of the weighted data-bits.

2. A method according to claim 1 wherein said step of illuminating the lattice includes a first step of illuminating the lattice during said first interval with a light source of said first predetermined colour characteristic and a second step of illuminating the lattice during said a respective interval with a light source of said a different predetermined colour characteristic.

3. A method according to claim 1 further comprising the step of blanking the lattice prior to each interval.

4. A method according to claim 1 wherein the step of blanking the lattice prior to each interval has a longer duration than a switching period between said first and second steps of illuminating the lattice.

5. A method according to claim 1 wherein the number of address times for said first interval is greater than the number of address times during said a respective interval whereby the resolution of said first predetermined colour is greater than the resolution of said different predetermined colour.

6. A method according to claim 1 wherein said first predetermined colour is green and the different predetermined colours are red and blue.

7. A display device comprising:

a lattice of pixel elements, each selectively settable in dependence upon a respective part of received data representing one picture for display in a display period, which data comprises data-bits weighted in accordance with their significance;

means for illuminating the lattice to produce, during a first interval within the display period, a first light output from the lattice having a first predetermined colour characteristic and to produce at least one additional light output from the lattice, each said additional light output having a different predetermined colour characteristic and having a respective interval within the display period and separate from the first interval;

and means for effecting time-multiplex addressing, with the data, blocks of pixel elements a plurality of address times for each interval of the illumination means;

the time-multiplex addressing means including means for selecting the blocks of pixel elements for time multiplex addressing such that the blocks of pixel elements are spatially separated in accordance with a binary sequence, and such that selected blocks are selectively set for display in accordance with the significance of the weighted data-bits.

8. A display device according to claim 7 wherein the illumination means comprises a light source of said first predetermined colour characteristic and a light source of each said different predetermined colour characteristic.

9. A display device according to claim 7 further comprising means for blanking the lattice prior to each interval.

* * * * *